US010465474B2

(12) United States Patent
Coffin et al.

(10) Patent No.: US 10,465,474 B2
(45) Date of Patent: Nov. 5, 2019

(54) ROTATING CROSSOVER SUBASSEMBLY

(71) Applicant: Halliburton Energy Services, Inc., Houston, TX (US)

(72) Inventors: Maxime Philippe Coffin, Frisco, TX (US); Gregory William Garrison, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/563,445

(22) PCT Filed: Dec. 27, 2016

(86) PCT No.: PCT/US2016/068749

§ 371 (c)(1),
(2) Date: Sep. 29, 2017

(87) PCT Pub. No.: WO2018/125059

PCT Pub. Date: Jul. 5, 2018

(65) Prior Publication Data

US 2018/0347311 A1 Dec. 6, 2018

(51) Int. Cl.
*E21B 33/12* (2006.01)
*E21B 34/06* (2006.01)
(Continued)

(52) U.S. Cl.
CPC ..... *E21B 34/06* (2013.01); *E21B 23/06* (2013.01); *E21B 33/12* (2013.01); *E21B 43/04* (2013.01);
(Continued)

(58) Field of Classification Search
CPC ..... E21B 34/04; E21B 34/06; E21B 33/1243; E21B 43/04
See application file for complete search history.

(56) References Cited

U.S. PATENT DOCUMENTS

2004/0244851 A1 12/2004 Joseph, III
2007/0251696 A1* 11/2007 Parks ..... E21B 23/004 166/373

(Continued)

OTHER PUBLICATIONS

International Search Report and Written Opinion dated Sep. 12, 2017; International PCT Application No. PCT/US2016/068749.

*Primary Examiner* — David J Bagnell
*Assistant Examiner* — Dany E Akakpo
(74) *Attorney, Agent, or Firm* — McGuire Woods LLP

(57) ABSTRACT

A system for use in completing a wellbore includes a portion of a workstring extending into the wellbore such that a first annulus is created between the workstring and a portion of the wellbore. The portion of the workstring is inserted to a depth corresponding to a base, such as a sump packer that defines a lower boundary of the completion zone. The zone of deployment may be sealed uphole by a second packer included in the workstring. A service tool having an inner sleeve, an outer sleeve, and a rotating mandrel positioned therebetween is provided to deliver fluids and execute completion operations as facilitated by rotation of the mandrel. Rotation of the mandrel allows for control of multiple fluid flow paths, each of which may correspond to a completion process within the zone, without displacement of the service tool in an uphole or downhole direction.

20 Claims, 10 Drawing Sheets

(51) Int. Cl.

| | |
|---|---|
| ***E21B 23/06*** | (2006.01) |
| ***E21B 43/04*** | (2006.01) |
| ***E21B 43/08*** | (2006.01) |
| *E21B 34/00* | (2006.01) |

(52) U.S. Cl.
CPC ..... *E21B 43/08* (2013.01); *E21B 43/045* (2013.01); *E21B 2034/007* (2013.01)

(56) References Cited

U.S. PATENT DOCUMENTS

| | | | |
|---|---|---|---|
| 2010/0032162 | A1 | 2/2010 | Dlstad et al. |
| 2011/0017469 | A1 | 1/2011 | Malone |
| 2012/0205094 | A1 | 8/2012 | Yeh et al. |
| 2014/0311753 | A1 | 10/2014 | Hanson et al. |

* cited by examiner

ROTATING CROSSOVER SUBASSEMBLY

BACKGROUND

The present disclosure relates to oil and gas exploration and production, and more particularly to a completion system for use in gravel packing operations.

Wells are drilled at various depths to access and produce oil, gas, minerals, and other naturally-occurring deposits from subterranean geological formations. Hydrocarbons may be produced through a wellbore traversing the subterranean formations. Gravel packing operations are commonly performed in subterranean formations to control unconsolidated particulates. A typical gravel packing operation involves placing a filtration bed containing gravel particulates near the well bore that neighbors the zone of interest. The filtration bed acts as a physical barrier to the transport of unconsolidated particulates to the well bore that could be produced with the produced fluids. One common type of gravel packing operation involves placing a sand control screen in the well bore and packing the annulus between the screen and the well bore with gravel particulates of a specific size designed to prevent the passage of formation sand. The packing operation may be completed using a service tool that is deployed on the workstring to complete a variety of processes, including packer setting, testing, fluid delivery and circulation, and pressurization of the wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF ILLUSTRATIVE EMBODIMENTS

Figure 1:
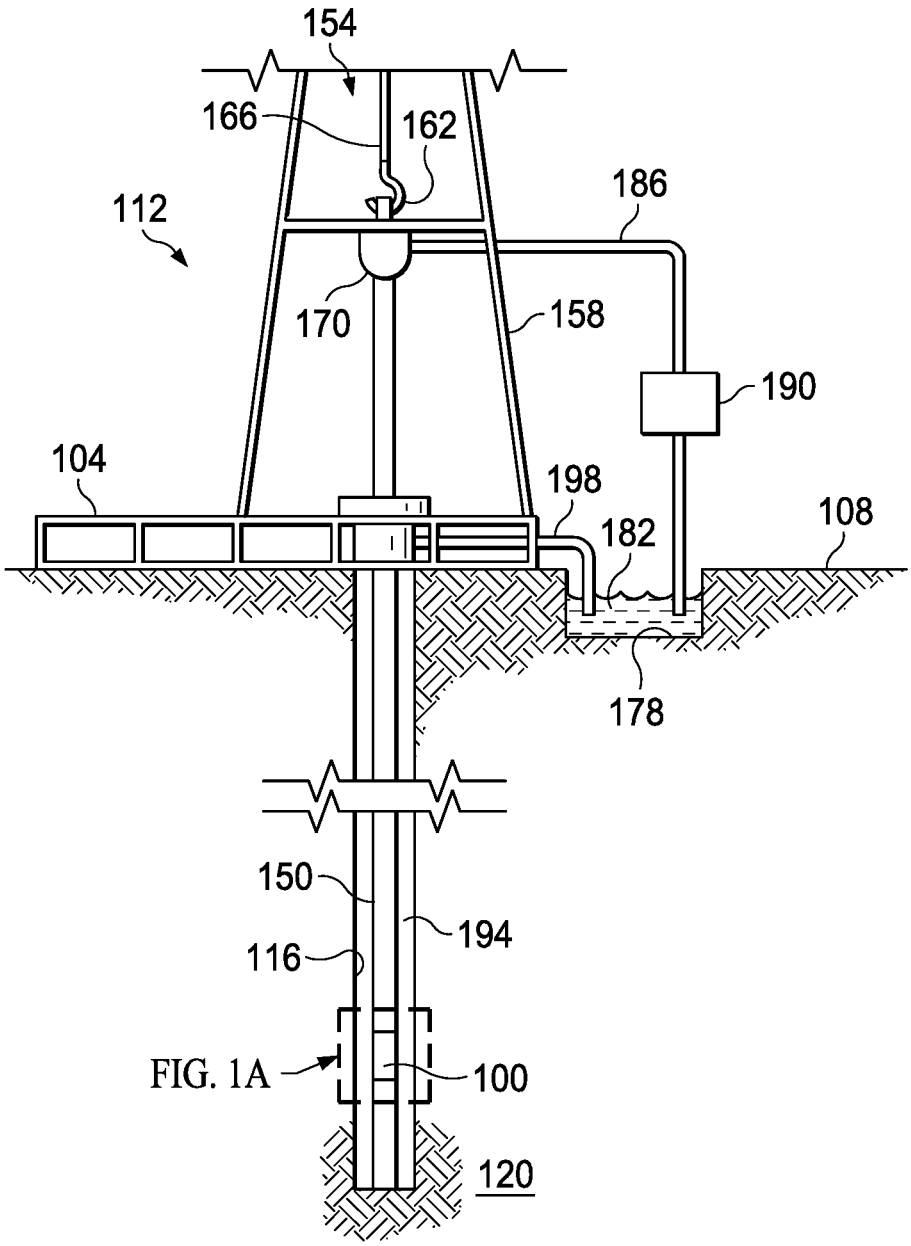
FIG. 1 illustrates a schematic view of an on-shore well having a completion system according to an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to systems and methods for completing a wellbore in a gravel pack or similar completion process. In accordance with an illustrative embodiment (as described in more detail below with regard to the figures), a system for completing a well includes a portion of a workstring extending into the wellbore such that a first annulus is created between the workstring and the wellbore wall. One or more packers are provided to seal between the workstring and a portion of the wellbore to define a completion zone. The system includes a service tool comprising an inner sleeve having an inner port, an outer sleeve having an outer port, and a rotating mandrel positioned between the inner sleeve and outer sleeve. The rotating mandrel defines a plurality of flow paths and may be rotated through a plurality of positions to control fluid flow (1) from the internal diameter of the workstring (workstring ID) to a crossover port of the workstring, (2) from an uphole portion of the workstring to a downhole washpipe, from a wellbore annulus to an uphole portion of the workstring, and from a downhole portion of the annulus that is below an uphole packer to an uphole portion of the annulus that is uphole from said packer. Rotation of the rotating mandrel allows the service tool to execute (1) a washdown process, (2) a packer setting process, (3) a packer test process, (4) a fluid circulation process, and (5) a reverse flow process without longtudinal displacement of the service tool.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

While a portion of a wellbore may in some instances be formed in a substantially vertical orientation, or relatively perpendicular to a surface of the well, the wellbore may in some instances be formed in a substantially horizontal orientation, or relatively parallel to the surface of the well, the wellbore may include portions that are partially vertical (or angled relative to substantially vertical) or partially horizontal (or angled relative to substantially horizontal). In some wellbores, a portion of the wellbore may extend in a downward direction away from the surface and then back up toward the surface in an "uphill," such as in a fish hook well. The orientation of the wellbore may be at any angle leading to and through the reservoir.

Figure 2:
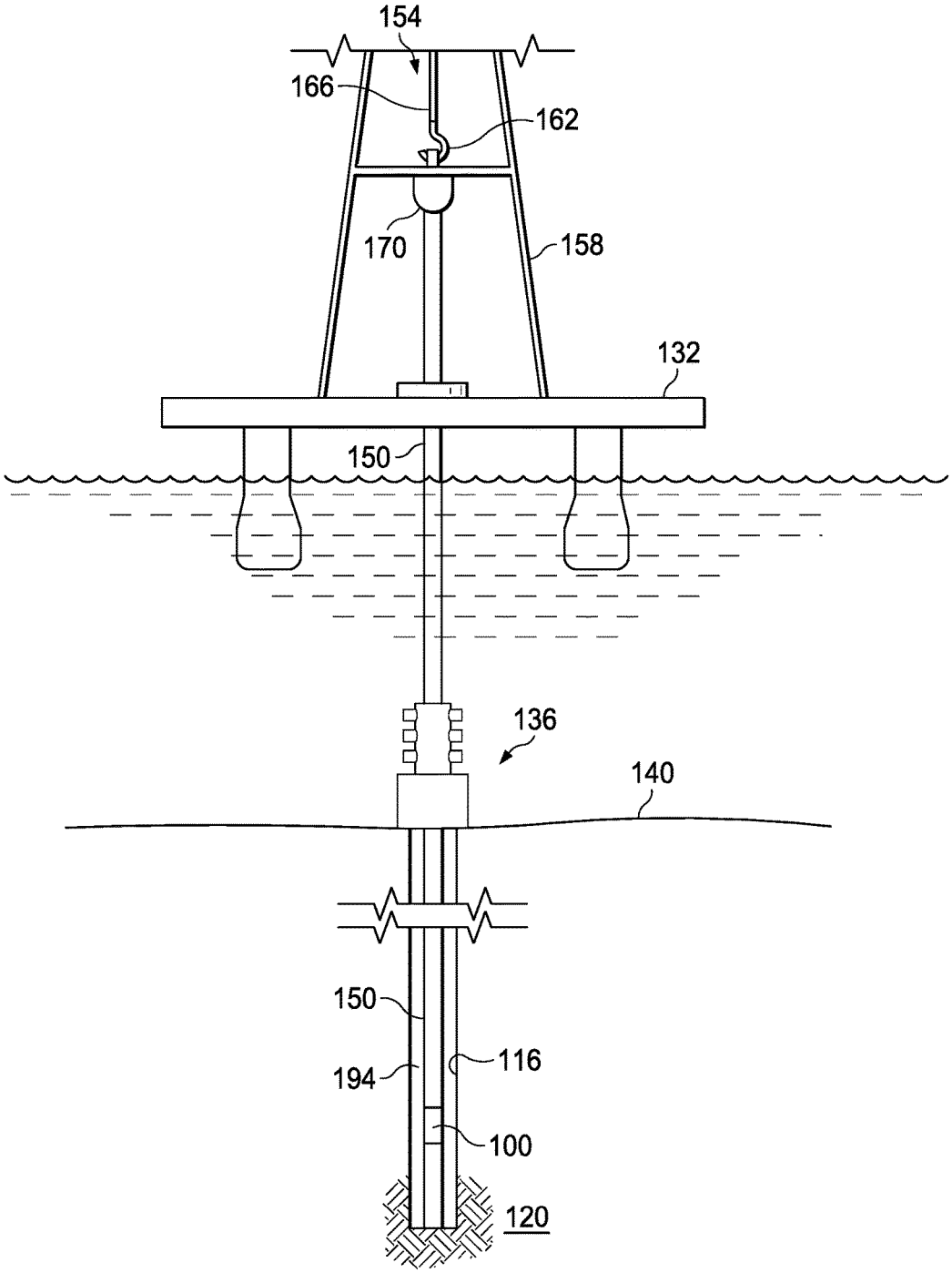
FIG. 2 illustrates a schematic view of an off-shore well having a completion system according to an illustrative embodiment.

Referring now to the figures, FIG. 1 illustrates a schematic view of a rig 104 operating a completion system 100 according to an illustrative embodiment. Rig 104 is positioned at a surface 108 of a well 112. The well 112 includes a wellbore 116 that extends from the surface 108 of the well 112 to a subterranean substrate or formation 120. The well 112 and rig 104 are illustrated onshore in FIG. 1. Alternatively, FIG. 2 illustrates a schematic view of an offshore platform 132 operating the completion system 100 according to an illustrative embodiment. The completion system 100 in FIG. 2 may be deployed in a sub-sea well 136 accessed by the offshore platform 132. The offshore platform 132 may be a floating platform or may instead be anchored to a seabed 140.

In the embodiments illustrated in FIGS. 1 and 2, the wellbore 116 has been formed by a drilling process in which dirt, rock and other subterranean material is removed to create the wellbore 116. During or after the drilling process, a portion of the wellbore may be cased with a casing (not illustrated). In other embodiments, the wellbore may be maintained in an open-hole configuration without casing. The embodiments described herein are applicable to either cased or open-hole configurations of the wellbore 116, or a combination of cased and open-hole configurations in a particular wellbore.

After drilling of the wellbore is complete and the associated drill bit and drill string are "tripped" from the wellbore 116, a workstring 150 is lowered into the wellbore 116. The workstring 150 may include sections of tubing, each of which are joined to adjacent tubing by threaded or other connection types. The workstring may refer to the collection of pipes or tubes as a single component, or alternatively to the individual pipes or tubes that comprise the string. The term workstring (or tubing string or production string) is not meant to be limiting in nature and may refer to any component or components that are capable of being coupled to the completion system 100 to lower or raise the completion system 100 in the wellbore 116 or to provide energy to the completion system 100 such as that provided by fluids, electrical power or signals, or mechanical motion. Mechanical motion may involve rotationally or axially manipulating portions of the workstring 150. In some embodiments, the workstring 150 may include a passage disposed longitudinally in the workstring 150 that is capable of allowing fluid communication between the surface 108 of the well 112 and a downhole location.

The lowering of the workstring 150 may be accomplished by a lift assembly 154 associated with a derrick 158 positioned on or adjacent to the rig 104 or offshore platform 132. The lift assembly 154 may include a hook 162, a cable 166, a traveling block (not shown), and a hoist (not shown) that cooperatively work together to lift or lower a swivel 170 that is coupled an upper end of the workstring 150. The workstring 150 may be raised or lowered as needed to add additional sections of tubing to the workstring 150 to position the completion system 100 at the downhole location in the wellbore 116.

A reservoir 178 may be positioned at the surface 108 to hold a fluid 182 for delivery to the well 112 during setting of the completion system 100. A supply line 186 is fluidly coupled between the reservoir 178 and the passage of the workstring 150. A pump 190 drives the fluid 182 through the supply line 186 and the workstring 150 toward the downhole location. As described in more detail below, the fluid 182 may also be used to carry out debris from the wellbore prior to or during the completion process. Still other uses of the fluid 182 may entail delivery of gravel or a proppant in a slurry to the downhole location so that the well 112 may be gravel packed. After traveling downhole, the fluid 182 or portions thereof returns to the surface 108 by way of an annulus 194 between the workstring 150 and the wellbore 116. At the surface 108, the fluid may be returned to the reservoir 178 through a return line 198. The fluid may be filtered or otherwise processed prior to recirculation through the well 112.

The present disclosure relates generally to completion systems that allow a variety of completion processes, including washdown, gravel pack, packer setting, packer testing, and reverse out, with reduced longitudinal displacement of the applicable service tool. In a typical gravel pack completion, crossover gravel packing equipment is used to deliver gravel to the wellbore. Washdown and reverse circulation methods may also be used.

Figure 1A:
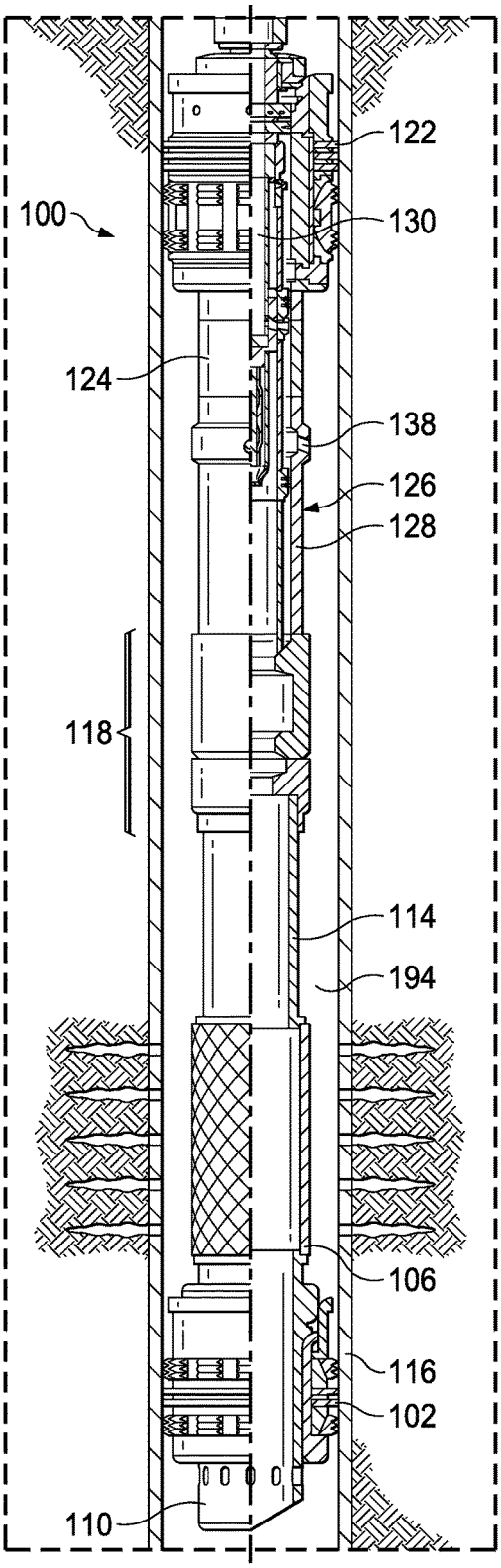
FIG. 1A is a detail view of a portion of the completion system of FIG. 1.

Referring to FIG. 1A, a gravel-pack completion system 100 is shown in more detail. Here, the completion system 100 includes a sump packer 102 that acts as a base on which a screen 106 will rest. In a typical deployment, a seal assembly 110 is used to establish a seal in the bore of the sump packer 102 to prevent gravel-pack sand from filling the downhole portion of the wellbore 116 during gravel packing. The seal assembly 110 may also provide for zonal isolation from the downhole portion of the wellbore 116. Uphole from the seal assembly 110, the gravel-pack screen 106 creates an annulus between the screen and the wellbore 116 or wellbore casing and holds the gravel in place during production (the wellbore 116 may be cased or uncased). Above the screen 106, a blank pipe 114 is typically used to provide a reservoir of gravel-pack sand above the screen to ensure that the screen remains completely packed in the event of settling after gravel deployment. Adjacent to the blank pipe 114, a shear joint 118 is usually provided to allow retrieval of the uphole portion of the completion system 100 following gravel deployment, independently of the blank pipe 114 and screen 106. Near the shear joint 118, a knock out isolation valve may be provided to prevent completion fluid losses and subsequent damage to the formation after performing the gravel pack.

Uphole from the shear joint 118, gravel-pack extensions are used with a packer 122, which may be a gravel-pack packer, and service tools to provide a flow path from the tubing above the packer 122 and to the screen/casing annulus below. The gravel-pack completion generally includes an upper extension 124 and lower extension 128. This portion of the completion system 100 typically houses a gravel-pack crossover tool throughout its range of motion. At the uphole portion of the gravel-pack completion system 100 is the packer 122, which isolates the zone of interest (for gravel packing) from the wellbore above. A service tool 130 is typically used to deploy the completion system 100 and facilitate the gravel pack, and is described in more detail below with regard to FIG. 3.

The service tool 130 includes a gravel pack crossover tool that creates various circulating paths for fluid flow during gravel packing. A typical crossover tool includes a series of molded seals surrounding a gravel-pack port midway down the tool and a return port near the top of the tool. A concentric tube (washpipe) design in the crossover tool along with the gravel-pack packer and gravel-pack extension allow fluid pumped down the workstring above the packer to "cross over" to the screen/casing annulus below the packer. Similarly, return fluids flowing up the washpipe and below the packer can "cross over" to the workstring/casing annulus above the packer. The crossover may have several operating positions, including a squeeze position, a circulation position, and a reverse circulation position. These operating positions may typically correspond to different depths of the service tool relative to the other components of the completion system 100 (e.g., the packer 122). The present disclosure, however, describes a service tool 130 having a crossover tool with a rotating mandrel, that provides for the various operating positions to be achieved by rotation of the rotating mandrel rather than by adjusting the depth of the crossover tool relative to the other components of the completion system 100.

Figure 3:
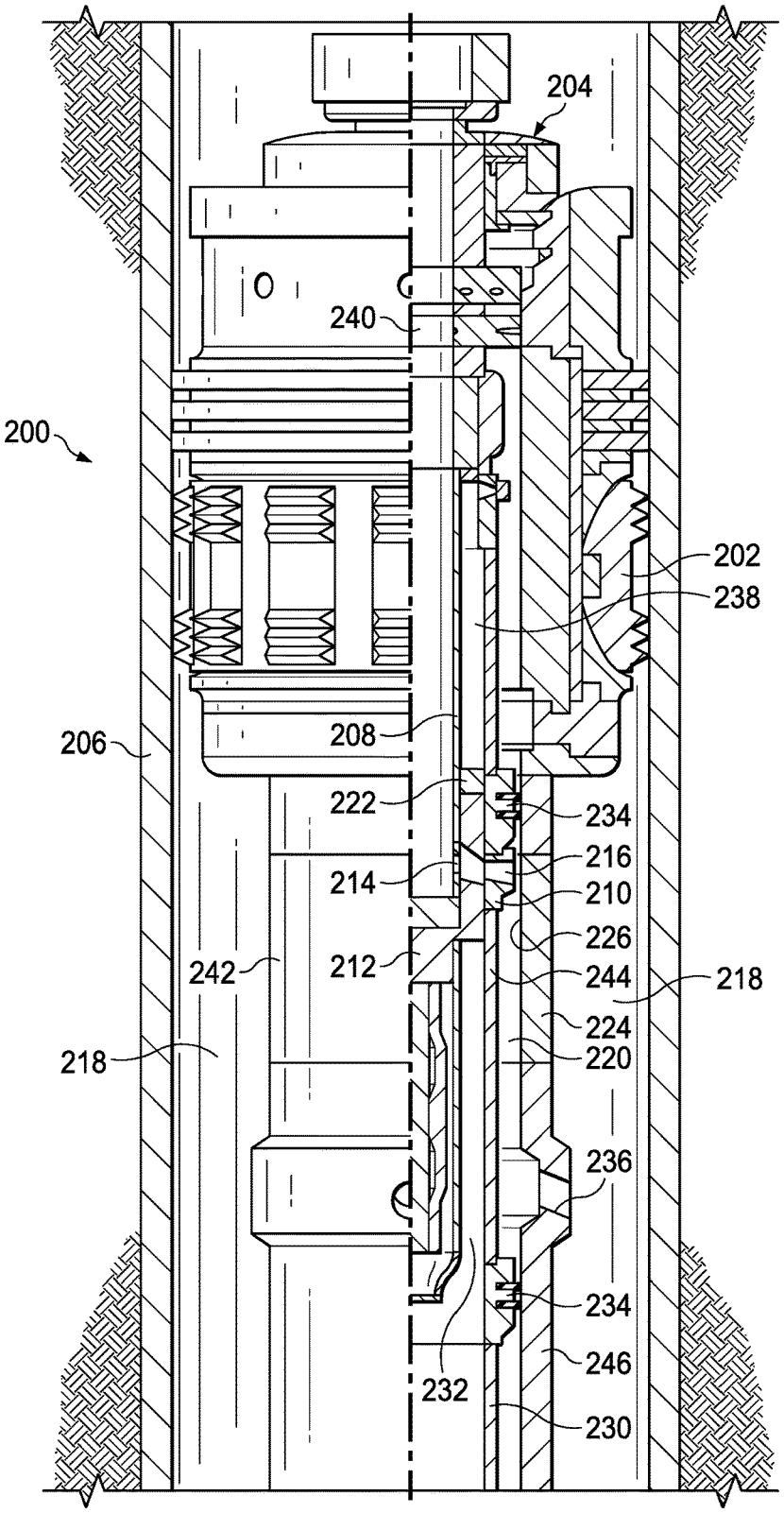
FIG. 3 illustrates a schematic and partially cut-away view of a portion of the completion system according to an illustrative embodiment.

Referring now to FIG. 3, a service tool 204 is shown at working depth within a workstring 200 of a completion system. As described above, the completion system includes a packer 202, which may be a gravel packer or similar packer. A first annulus 218 is formed between a wall of the wellbore 206 and the workstring external surface 224. A second annulus 220 is formed between an workstring internal surface 226 and an outer service tool surface 244. The service tool 204 includes an inner sleeve 208 having an inner port 214 that is aligned with an outer port 216 of an outer sleeve 210. A rotating mandrel 212 is positioned between the inner sleeve 208 and outer sleeve 210 and is operable to rotate about a central axis of the service tool 204 through a plurality of operating positions to control fluid flow through the inner port 214 and outer port 216. A mandrel cover 222 is positioned adjacent to the rotating mandrel 212. As described below, the rotating mandrel 212 is also operable to control fluid flow across one or more return ports formed within the mandrel cover 222.

It is noted that while the embodiments shown include the inner sleeve 208 and outer sleeve 210, the present disclosure contemplates a service tool 204 that omits either the inner sleeve 208 or outer sleeve 210.

The outer sleeve 210 of the service tool 204 may include a washpipe segment 230 that extends below the rotating mandrel 212 and defines a lower tool annulus 232 that is fluidly coupled to the interior of the washpipe 230. The service tool 204 also includes a plurality of seals 234 that seal against the workstring internal surface 226 to define one or more fluid flow paths. For example, a seal 234 may be disposed downhole from but proximate to a crossover port 236 to define a fluid flow path from the outer port 216, through the second annulus 220, and across the crossover port 236 to flow a gravel slurry or other fluid to the portion of the first annulus 218 between workstring 200 and wellbore 206 in the zone between the packer 202 and downhole sump packer 102 (described above with regard to FIG. 1A).

In addition, a fluid flow path from the lower tool annulus 232 may be controllably coupled to an upper tool annulus 238 via a return port in the mandrel cover 222 when a return conduit in the rotating mandrel 212 is aligned with a return port in the mandrel cover 222 (as described in more detail below). In such embodiments, the upper tool annulus 238 may ultimately be fluidly coupled with an uphole zone of the first annulus 218 that is isolated by (and uphole of) the packer 202.

Figure 4A:
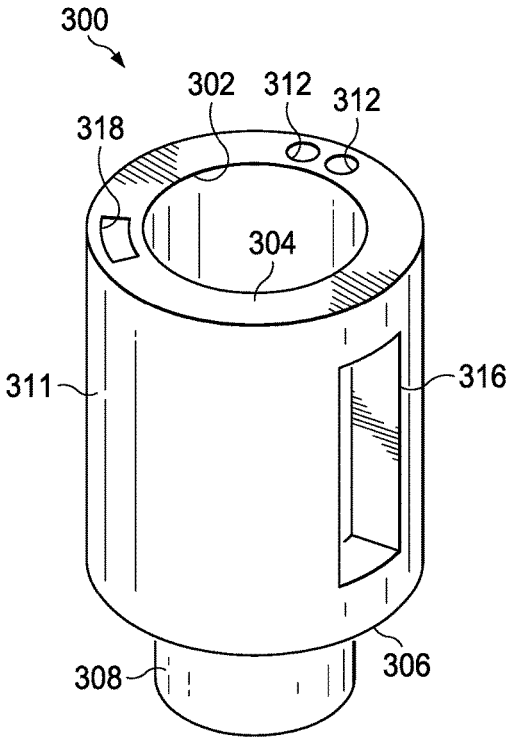
FIG. 4A is a perspective view of a rotatable mandrel, analogous to the rotatable mandrel of the service tool of FIG. 3.
Figure 4B:
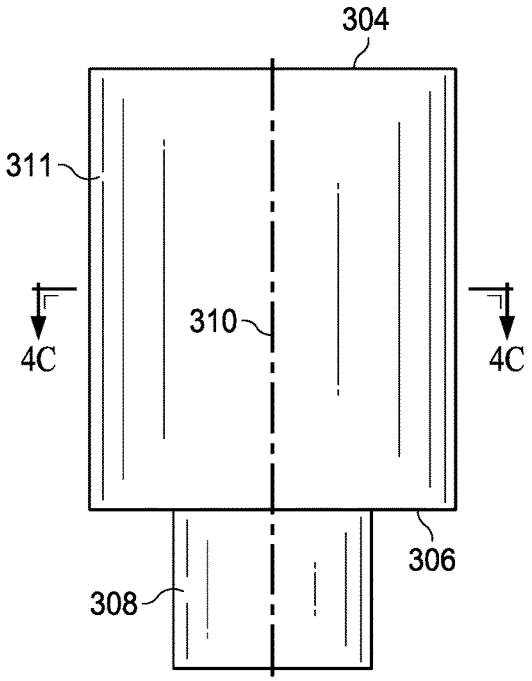
FIG. 4B is a side view of the rotatable mandrel of FIG. 4A.
Figure 4C:
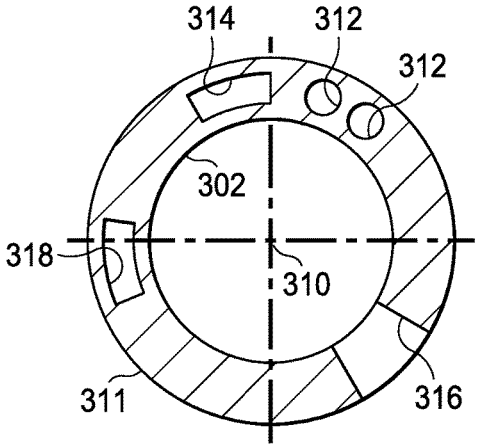
FIG. 4C is a top, section view of the rotatable mandrel of FIG. 4A, taken along the lines 4C-4C shown in FIG. 4B.

An exemplary rotating mandrel 300 is described in more detail with regard to FIGS. 4A-4C. The rotating mandrel 300 is a generally cylindrical part that includes an inner cavity 302, a cylindrical outer surface 311, an upper surface 304, and a lower surface 306. The rotating mandrel 300 may also include a boss 308 to provide a mounting surface for coupling with downhole portions of a service tool, and is operable to rotate about a central axis 310 when installed within the service tool. To control flow across a completion system, such as completion system 100 described above, the rotating mandrel includes a plurality of conduits. For example, the rotating mandrel may include one or more of each of the following conduits: (a) a return conduit 312 that provides a fluid flow path from the lower surface 306 to the upper surface 304; (b) a washdown conduit 314 extending from the inner cavity 302 to the lower surface 306; (c) a circulation conduit 316 extending from the inner cavity 302 through the outer surface 311, and (d) a reverse flow conduit 318 extending from the inner cavity 302 to the upper surface 304.

Within a completion system, depending on the orientation of the rotating mandrel 300 relative to other components in the service tool and completion system, the return conduit 312 may provide a path for return flow across the service tool when aligned with return ports in a sealing ring or cover (such as mandrel cover 222 described above with regard to FIG. 3). Similarly, the washdown conduit 314 may provide a path for washdown flow or hydraulic pressure when aligned with an inner port (such as inner port 214 of FIG. 3) of the service tool; the circulation conduit 316 may provide a path for circulatory flow when aligned with an inner port and outer port (such as inner port 214 and outer port 216 of FIG. 3) of the service tool; and the reverse flow conduit 318 may provide a path for reverse flow when aligned with an inner port (such as inner port 214 of FIG. 3) of the service tool.

Figure 5A:
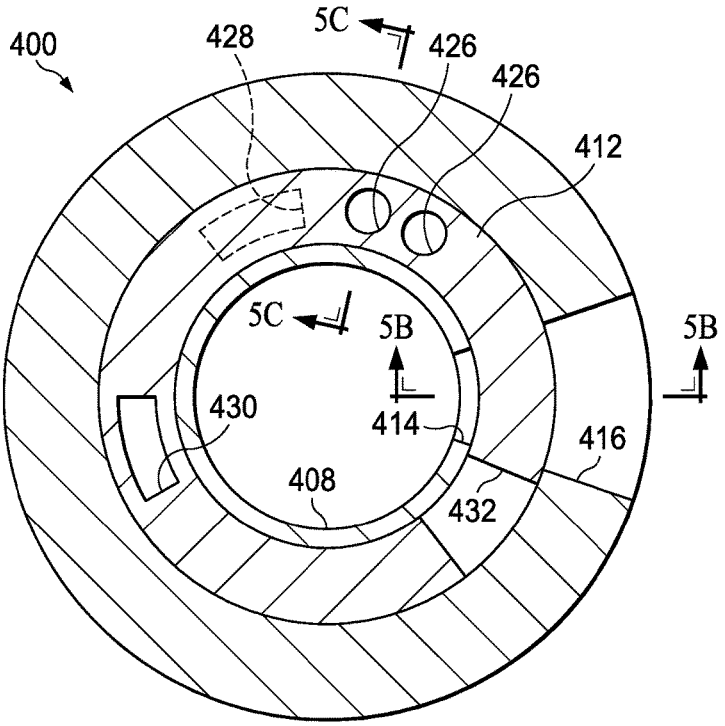
FIG. 5A is a top, section view of a service tool, analogous to the service tool of FIG. 3 in which the rotatable mandrel is rotated to a first position.
Figure 5B:
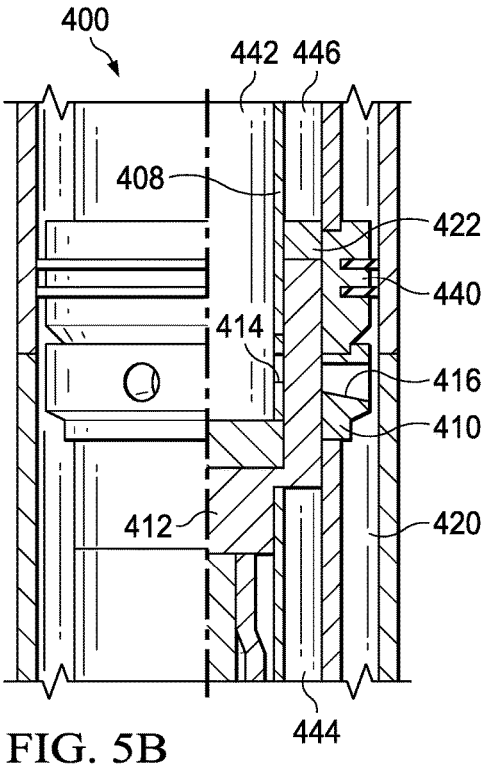
FIG. 5B is a side, partial section view of the service tool of FIG. 5A, taken along the lines 5B-5B shown in FIG. 5A.
Figure 5C:
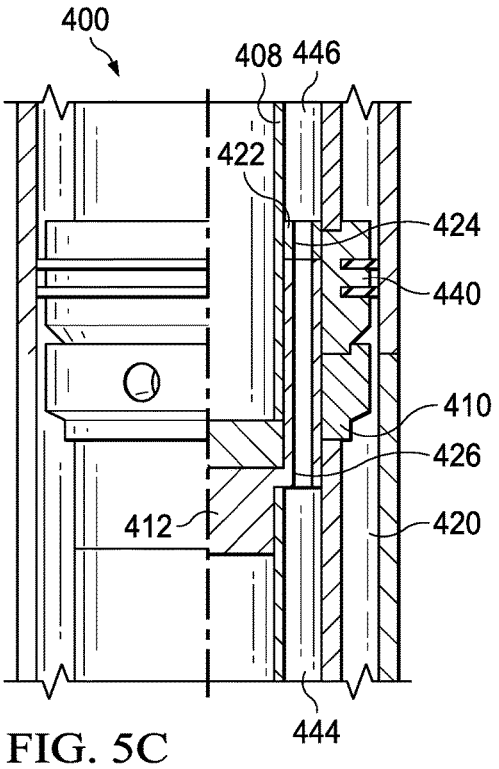
FIG. 5C is a side, partial section view of the service tool of FIG. 5A, taken along the lines 5C-5C shown in FIG. 5A.

FIGS. 5A-5C through 9A-9C show the operation of a service tool 400 as a rotating mandrel of the service tool 400 is rotated through a plurality of operating positions. FIGS. 5A-5C show service tool 400 in an orientation that restricts flow from a tool bore 442 of the service tool 400 by rotating a rotating mandrel 412 to a first position. To facilitate rotation of the rotating mandrel 412, the rotating mandrel 412 may be coupled to a motor and control system. The motor and control system may include, for example, a computer controlled, downhole hydraulic power unit that is deployed as part of the service tool 400 and used to remotely operate the service tool 400 by inducing rotational motion of the rotating mandrel 412 based on remotely generated signals. Such signals may be pressure-based, acoustically based, or a combination of various signals. In some embodiments, the rotating mandrel 412 and mandrel cover 422 may be independently and controllably rotatable by the motor and control system to achieve the various orientations and processes described herein.

When the mandrel is rotated to a first position, return conduits 426 of the rotating mandrel 412 are aligned with return ports 424 of the mandrel cover 422 to fluidly couple an upper tool annulus 446 of the service tool 400 with a lower tool annulus 444 while restricting flow from an tool bore 442 of the service tool 400. In this position, flow from the tool bore 442, from the inner port 414 to the outer port 416, is blocked by a solid portion of the rotating mandrel 412. This first position may correspond to a "packer setting" position by enabling the pressurization of the tool bore 442 of the service tool 400.

Figure 6A:
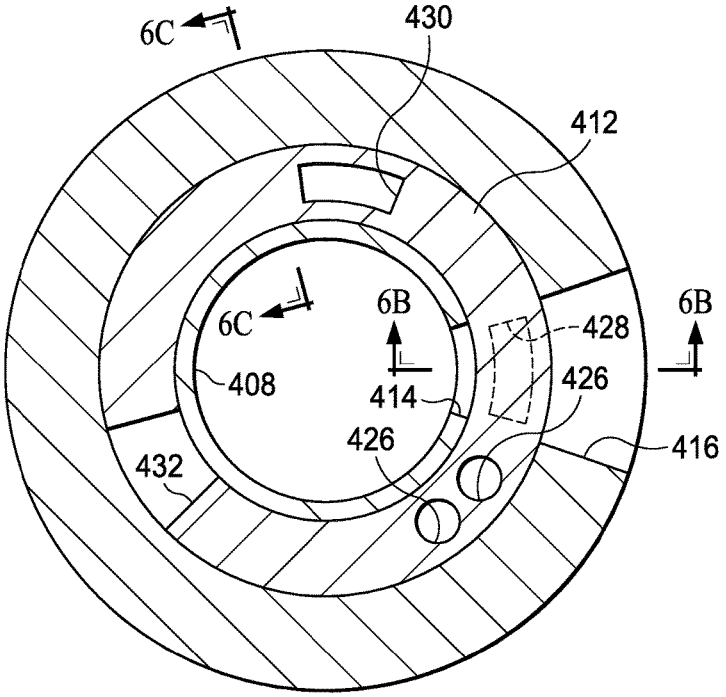
FIG. 6A is a top, section view of the service tool, in which the rotatable mandrel is rotated to a second position.
Figure 6B:
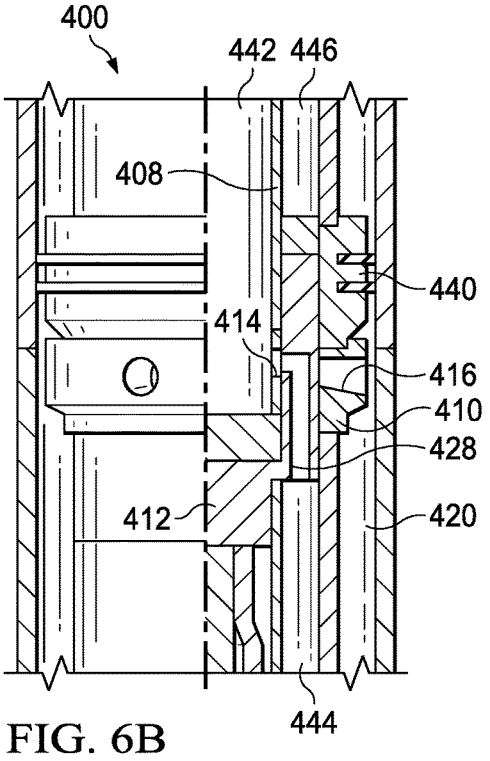
FIG. 6B is a side, partial section view of the service tool of FIG. 6A, taken along the lines 6B-6B shown in FIG. 6A.
Figure 6C:
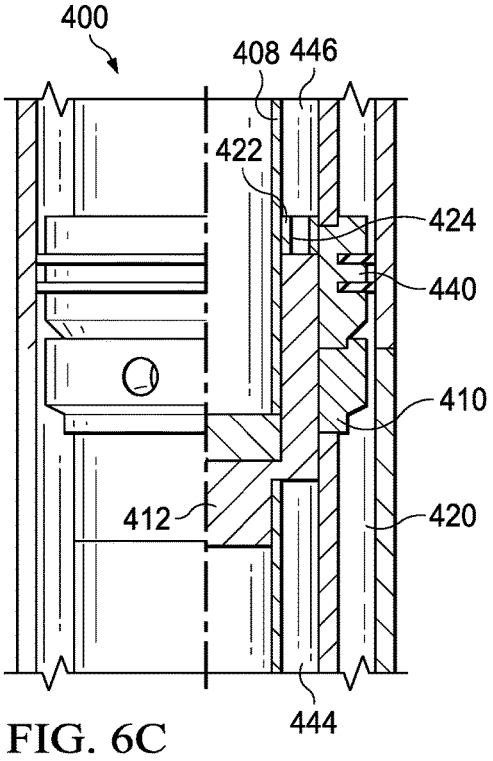
FIG. 6C is a side, partial section view of the service tool of FIG. 6A, taken along the lines 6C-6C shown in FIG. 6A.

FIGS. 6A-6C show service tool 400 in an orientation that provides for a washdown operation by fluidly coupling the tool bore 442 to the lower tool annulus 444 while restricting flow across the return ports 424 by rotating the rotating mandrel 412 to a second position. In the second position, return conduits 426 of the rotating mandrel 412 are misaligned with return ports 424 of the mandrel cover 422 to fluidly isolate the upper tool annulus 446 from the lower tool annulus 444 while allowing flow from (or a fluid coupling between) the tool bore 442 to the lower tool annulus 444. In this position, flow from the tool bore 442, from the inner port 414, is directed to the lower tool annulus 444 by a washdown conduit 428 that is rotated into alignment with the inner port 414. This second position may correspond to a "bullheading" position, which may also be referred to as a "washdown" or "treat" position by enabling pressurization of the wellbore and formation below the packer.

Figure 7A:
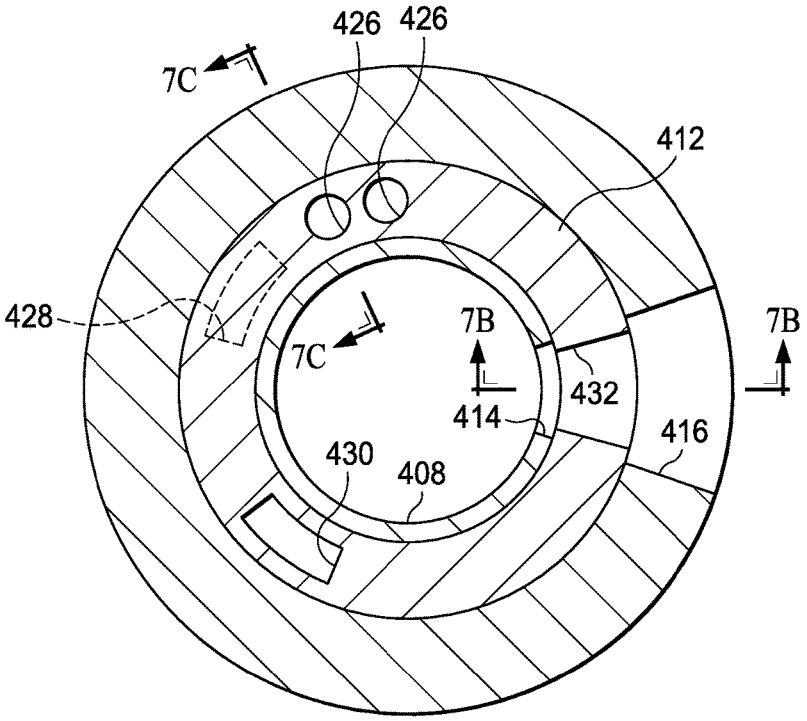
FIG. 7A is a top, section view of a service tool, in which the rotatable mandrel is rotated to a third position.
Figure 7B:
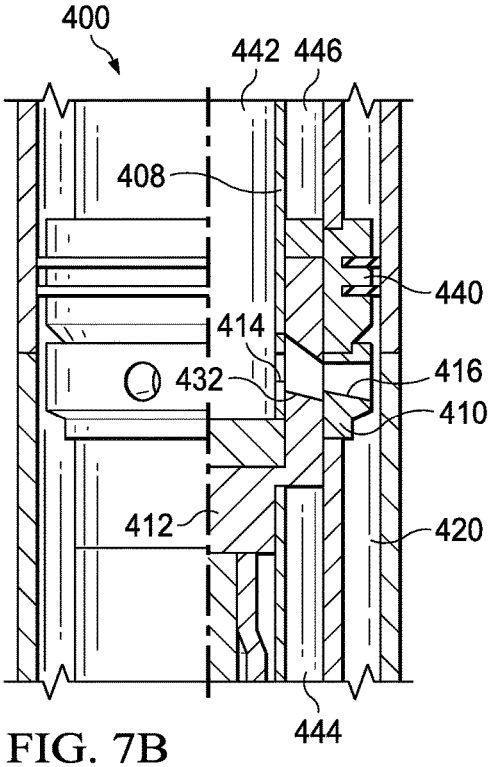
FIG. 7B is a side, partial section view of the service tool of FIG. 7A, taken along the lines 7B-7B shown in FIG. 7A.
Figure 7C:
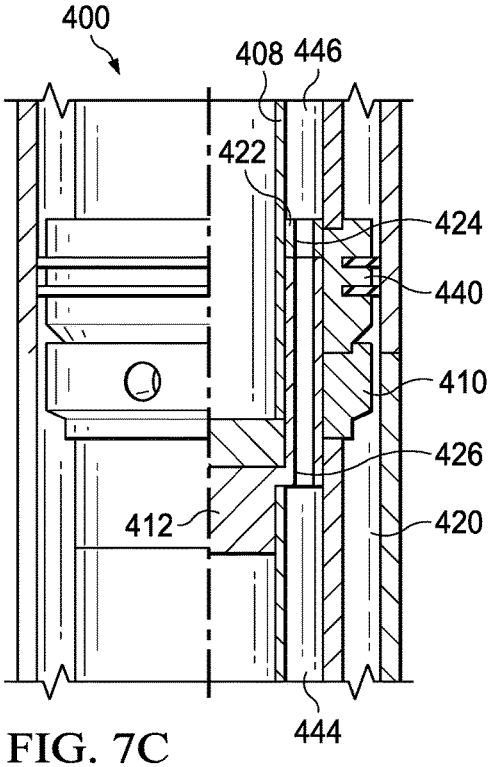
FIG. 7C is a side, partial section view of the service tool of FIG. 7A, taken along the lines 7C-7C shown in FIG. 7A.

FIGS. 7A-7C show service tool 400 in an orientation that provides for circulation through the completion system by fluidly coupling the tool bore 442 to a second annulus 420 (analogous to second annulus 220 of FIG. 3) while also allowing flow across the return ports 424 by rotating the rotating mandrel 412 to a third position. In the third position, return conduits 426 of the rotating mandrel 412 are aligned with return ports 424 of the mandrel cover 422 to fluidly couple the upper tool annulus 446 with the lower tool annulus 444 while also allowing flow from (or a fluid coupling between) the tool bore 442 to the second annulus 420 between the service tool 400 and completion system. In this position, flow from the tool bore 442, from the inner port 414, is directed to the second annulus 420 by a circulation conduit 432 that is rotated into alignment with the inner port 414 and outer port 416.

Figure 8A:
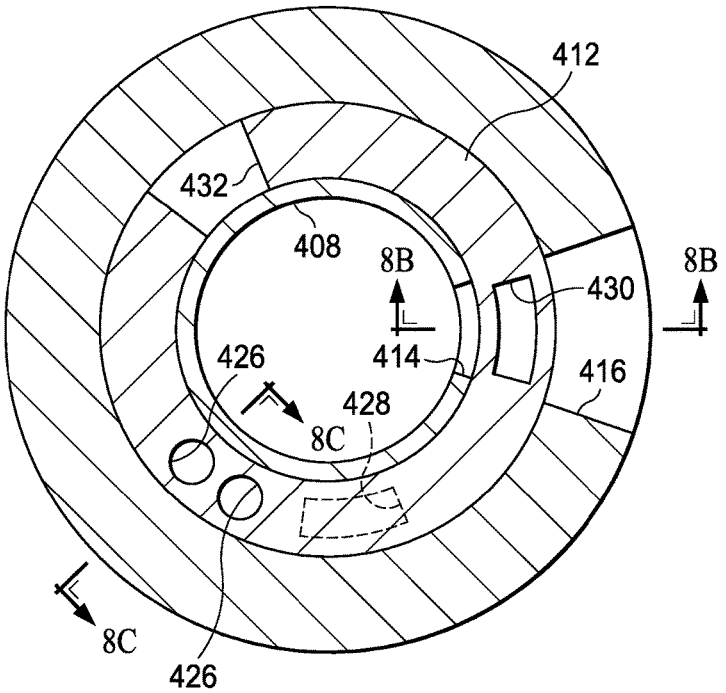
FIG. 8A is a top, section view of a service tool, in which the rotatable mandrel is rotated to a fourth position.
Figure 8B:
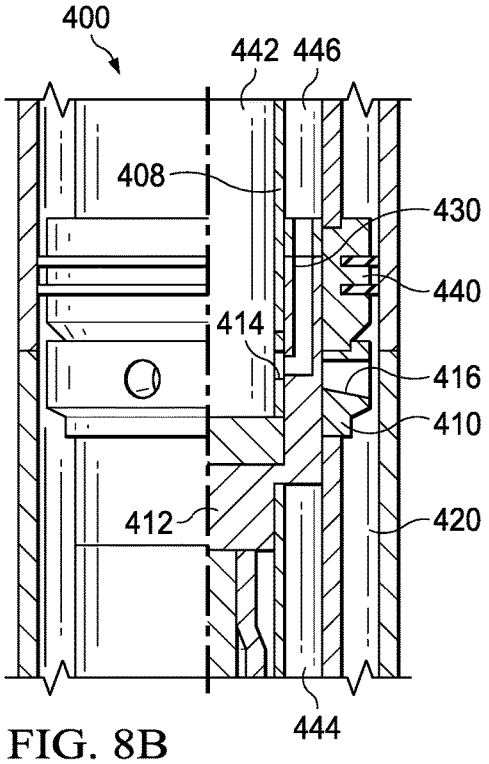
FIG. 8B is a side, partial section view of the service tool of FIG. 8A, taken along the lines 8B8-B shown in FIG. 8A.
Figure 8C:
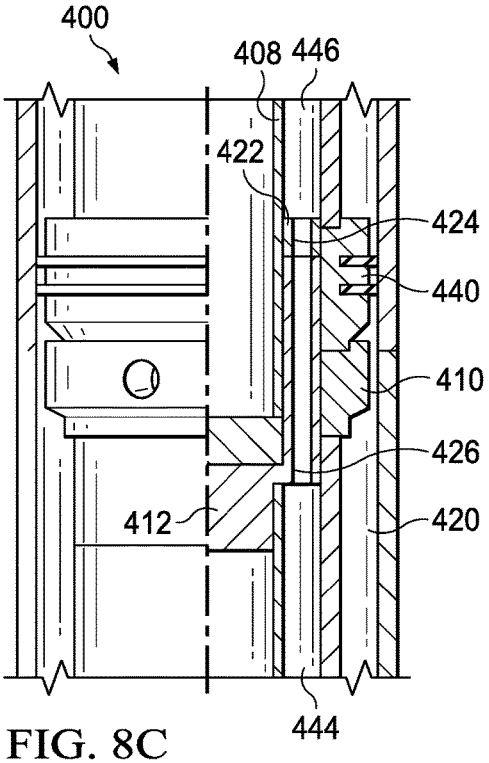
FIG. 8C is a side, partial section view of the service tool of FIG. 8A, taken along the lines 8C-8C shown in FIG. 8A.

FIGS. 8A-8C show service tool 400 in an orientation that provides for "reversing out" of the service tool by fluidly coupling the tool bore 442 to the upper tool annulus 446 while also allowing flow across the return ports 424 by rotating the rotating mandrel 412 to a fourth position. In the fourth position, the reverse flow conduit 430 of the rotating mandrel 412 is aligned with return ports 424 of the mandrel cover 422 to fluidly couple the upper tool annulus 446 with the tool bore 442 of the workstring. In this position, flow from the upper tool annulus 446 is directed through the inner port 414 from the upper tool annulus 446 by the reverse flow conduit 430, which is rotated into alignment with the inner port 414.

Figure 9A:
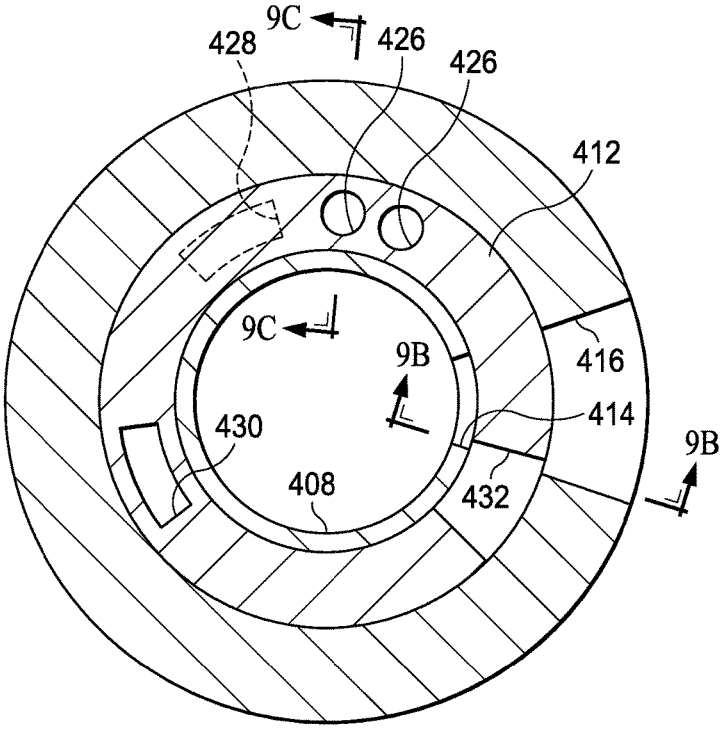
FIG. 9A is a top, section view of a service tool, in which the rotatable mandrel is rotated to a fifth position.
Figure 9B:
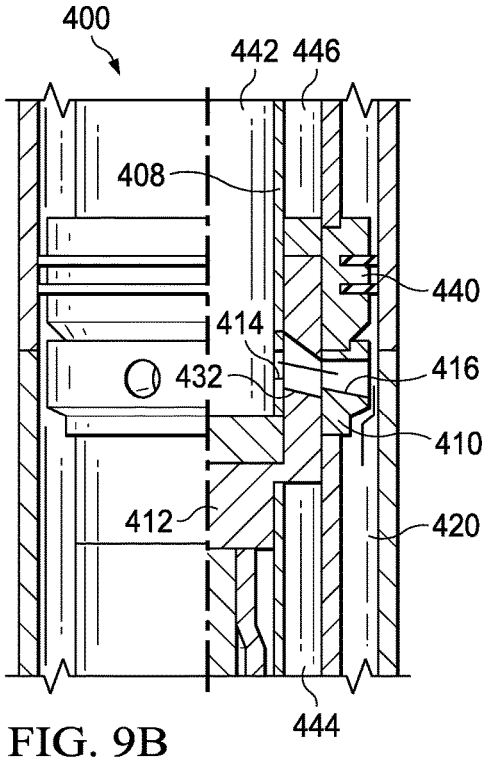
FIG. 9B is a side, partial section view of the service tool of FIG. 9A, taken along the lines 9B-9B shown in FIG. 9A.
Figure 9C:
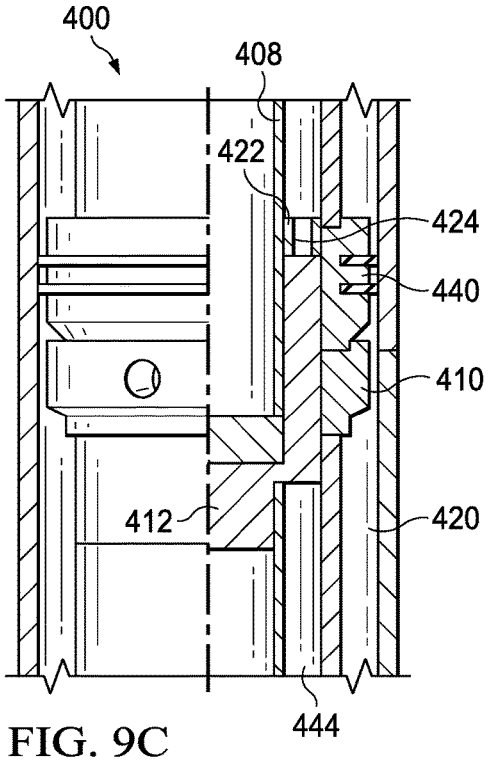
FIG. 9C is a side, partial section view of the service tool of FIG. 9A, taken along the lines 9C-9C shown in FIG. 9A.

FIGS. 9A-9C show service tool 400 in an orientation that provides for a packer test operation by fluidly coupling the tool bore 442 to a second annulus 420 (analogous to second annulus 220 of FIG. 3) while restricting flow across the return ports 424 by rotating the rotating mandrel 412 to a fifth position. In the fifth position, return conduits 426 of the rotating mandrel 412 are misaligned with return ports 424 of the mandrel cover 422 to fluidly isolate the upper tool annulus 446 from the lower tool annulus 444 while allowing restricted flow from (or a fluid coupling between) the tool bore 442 to the second annulus 420 between the service tool 400 and completion system. In this position, flow from the tool bore 442, from the inner port 414, is directed to the second annulus 420 by circulation conduit 432, which is rotated into at least partial alignment with the inner port 414 and outer port 416.

In some embodiments, one or more of the washdown conduit 428, reverse flow conduit 430, circulation conduit 432, and return conduits 426 may be formed or limited to allow flow only in a single direction. For example, each of the aforementioned conduits may be provided with a weeping ball seat or check valve. In addition, it is noted that the rotating mandrel 412 and/or mandrel cover 422 may be equipped with sealing features, such as a sealing ring, that provide a fluid seal between the rotating mandrel 412 and mandrel cover and outer sleeve 410 (respectively).

The representative systems and tools described above may be implemented in accordance with the following illustrative methods or a portion thereof. Referring again to FIGS. 1 and 1A, an illustrative method of completing a wellbore 116 includes deploying a portion of a workstring 150 to a depth within the wellbore 116 and forming an annulus between the wall of the wellbore 116 and workstring 150. The workstring 150 includes a seal assembly 110 that is stabbed into the sump packer 102 to isolate the portion of the annulus 194 in which the gravel screen 106 is positioned uphole from the sump packer 102 from the lower adjacent wellbore. A segment of blank pipe 114 is adjacent to the gravel screen 106 downhole from a shear joint 118. Uphole from the shear joint 118, the workstring 150 includes an lower extension 128, seal bore 126, and upper extension 124. A second packer 122, which may be a gravel-pack sealbore packer, is positioned uphole from and adjacent to the upper extension 124, and a closable port 138 is positioned between the second packer 122 and seal bore 126 to facilitate the passage of gravel slurry to the annulus 194.

The method further includes deploying the workstring 150 with the service tool 130. As shown in FIG. 3, the service tool 204 extends through the packer 202, upper extension 242, and sealbore 246. As noted above, the service tool 204 includes a plurality of seals 234 that seal against the interior of the workstring 200 to define one or more flow paths. The service tool 204 includes an inner sleeve 208 having an inner port 214 that is fluidly coupled to a tool bore 240 and an outer sleeve 210 having an outer port 216 that is fluidly coupled to the second annulus 220. A circulation path between the inner port 214 and outer port 216 may be selectively opened and closed by rotating a circulation conduit of the rotating mandrel 212 into and out of alignment with the inner port 214 and outer port 216.

As noted above, the inner sleeve 208 defines the tool bore 240 uphole from the rotating mandrel 212 and forms an upper tool annulus 238 between the inner sleeve 208 and outer sleeve 210 uphole from the rotating mandrel 212. The inner sleeve 208 also defines a lower tool annulus 232 between the inner sleeve 208 and outer sleeve 210 downhole from the rotating mandrel 212, and the outer sleeve 210 correspondingly defines a second annulus 220 between the outer sleeve 210 and the inner surface of the upper extension 242 of the workstring 200. It is noted that in some embodiments, each of the inner sleeve 208 and outer sleeve 210 may comprise a plurality of intervening sleeve or pipe segments that are directly or indirectly joined.

The illustrative method may include rotating the rotating mandrel 212 to a first position, as shown in FIGS. 5A-5C (see mandrel 412), in which the body of the rotating mandrel 412 restricts fluid flow from the inner port 414 to the outer port 416. The method may further include pressurizing a fluid within the tool bore 442 to set a packer (for example, packer 202 of FIG. 3) to form a seal between the completion assembly and a portion of the wellbore.

In some embodiments, the illustrative method alternatively or additionally includes rotating the rotating mandrel to a second position, as shown in FIGS. 6A-6C, to permit fluid flow across the washdown conduit 428 of the rotating mandrel 412. In the second position, an inlet of the washdown conduit 428 is aligned with the inner port 414 to allow fluid flow or the transmission of hydraulic pressure from the tool bore 442 to the lower tool annulus 444. In the second position, the return conduits 426 of the rotating mandrel 412 are misaligned with the return port 424 of the mandrel cover 422 to prevent flow between the upper tool annulus 446 and lower tool annulus 444. In this embodiment, the method may further include providing positive fluid flow or pressure from the service tool 400, through the washdown conduit 428 to apply positive pressure to the applicable zone of the wellbore (described above with regard to FIG. 1A).

In some embodiments, the illustrative method alternatively or additionally includes rotating the rotating mandrel 412 to a third position, as shown in FIGS. 7A-7C, in which fluid is permitted to flow from the inner port 414 to the outer port 416 across the circulation conduit 432. In the third position, the return conduits 426 of the rotating mandrel 412 are aligned with the return port 424 of the mandrel cover 422 to allow flow between from the lower tool annulus 444 to the upper tool annulus 446. In such an embodiment, the illustrative method may include delivering a fluid, such as a gravel slurry, to the wellbore zone, by flowing fluid through the service tool and across the circulation conduit 432 to the second annulus 420. As shown above, the second annulus 420 is fluidly coupled to a crossover port (see crossover port 236 of FIG. 3) of the wellbore, allowing fluid to flow through the crossover port in and to the first annulus (see annulus 218 of FIG. 3) to fill the zone until the fluid reaches the base of the washpipe (see washpipe 230 of FIG. 3) where the fluid flows back uphole into the lower tool annulus 232 and through the return conduits 426.

In some embodiments, the illustrative method alternatively or additionally includes rotating the rotating mandrel 412 to a fourth position, as shown in FIGS. 8A-8C, in which fluid is permitted to flow across the reverse flow conduit 430 extending from the tool bore 442 to the upper tool annulus 446. In the fourth position, the reverse flow conduit 430 is aligned with the inner port 414 of the inner sleeve 408 and the return conduits 426 of the rotating mandrel cover 422, while the return conduits 426 of the rotating mandrel 412 are also aligned with the return port 424 of the mandrel cover 422, thereby allowing flow between the tool bore 442 and upper tool annulus 446 while also providing a fluid coupling between the lower tool annulus 444 and upper tool annulus 446. In such an embodiment, the method may further include circulating fluid from the upper tool annulus 446 to the lower tool annulus 444 of the service tool so that the service tool may be retrieved from the workstring while maintaining relative fluid equilibrium within the wellbore, workstring, and service tool.

In some embodiments, the illustrative method alternatively or additionally includes rotating the rotating mandrel 412 to a fifth position, as shown in FIGS. 9A-9C. In the fifth position, as shown in FIG. 9A, the circulation conduit 432 is partially aligned with the inner port 414 and outer port 416 to enable nominal fluid flow or the transmission of hydraulic pressure to the second annulus 420, and correspondingly to the first annulus (see annulus 218 of FIG. 3) to maintain pressure on the reservoir. Simultaneously, the return conduits 426 of the rotating mandrel 412 are misaligned with the return port 424 of the mandrel cover 422 to prevent flow from the lower tool annulus 444 to the upper tool annulus 446, thereby enabling an operator to test the effectiveness of the packer (see packer 202 of FIG. 3).

It should be apparent from the foregoing that embodiments of an invention having significant advantages have been provided. While the embodiments are shown in only a few forms, the embodiments are not limited but are susceptible to various changes and modifications without departing from the spirit thereof. For example, the invention should be understood as including at least the following exemplary embodiments:

Example 1

A system for use in a wellbore includes a portion of a workstring extending into the wellbore and a packer adapted to seal across a first annulus between the workstring and a portion of the wellbore. The system further includes a screen downhole from the packer and a service tool comprising a rotating mandrel positionable within the workstring. The rotating mandrel is operable to control fluid flow from the tool bore of the service tool.

Example 2

The system of example 1, wherein the service tool further includes an inner sleeve having an inner port, and an outer sleeve having an outer port, and wherein the rotating mandrel is positioned between the inner sleeve and outer sleeve. The inner sleeve defines an upper tool annulus between the inner sleeve and the outer sleeve uphole from the rotating mandrel, and also defines a lower tool annulus between the inner sleeve and the outer sleeve downhole from the rotating mandrel.

Example 3

The system of example 2, wherein the service tool further comprises a mandrel cover having one or more return ports and the rotating mandrel further includes one or more return conduits. In this example, the rotating mandrel is operable to control fluid flow across the return ports.

Example 4

The system of example 3, wherein the one or more return conduits align with the one or more return ports to provide a fluid flow path between the lower tool annulus and the upper tool annulus when the rotating mandrel is rotated into a first position.

Example 5

The system of example 4, wherein the rotating mandrel is operable to rotate about a central axis, and wherein the rotating mandrel comprises an upper surface, a lower surface, an outer surface, and a cavity that is fluidly coupled to the tool bore of the service tool.

Example 6

The system of example 5, wherein the rotating mandrel comprises a washdown conduit extending from the cavity to the lower surface, and wherein the washdown conduit aligns with the inner port to provide a fluid flow path between the inner port to the lower tool annulus when the rotating mandrel is rotated into a second position.

Example 7

The system of example 5, wherein the rotating mandrel comprises a circulation conduit extending from the cavity through the outer surface, and wherein the circulation conduit aligns with the inner port and outer port to provide a fluid low path therebetween when the rotating mandrel is rotated into a third position.

Example 8

The system of example 7, wherein: the service tool further comprises a mandrel cover having one or more return ports; the rotating mandrel further comprises one or more return conduits; and wherein the one or more return conduits align with the one or more return ports to provide a fluid flow path between the lower tool annulus and the upper tool annulus when the rotating mandrel is rotated into the third position.

Example 9

The system of example 5, wherein the rotating mandrel comprises a reverse flow conduit extending from the cavity to the upper surface, and wherein the reverse flow conduit is fluidly coupled to the inner port to provide a fluid flow path between the tool bore and the upper tool annulus when the rotating mandrel is rotated into a fourth position.

Example 10

The system of example 9, wherein the service tool further comprises a mandrel cover having one or more return ports; the rotating mandrel further comprises one or more return conduits, and wherein the one or more return conduits align with the one or more return ports to provide a fluid flow path between the lower tool annulus and the upper tool annulus when the rotating mandrel is rotated into the fourth position.

Example 11

A downhole tool including a rotating mandrel having an upper surface, a lower surface, and an outer surface, and a cavity. The rotating mandrel includes a first conduit extending from the upper surface to the lower surface and a second conduit extending from the cavity to the lower surface.

Example 12

The downhole tool of example 11, wherein the rotating mandrel further comprises a third conduit extending from the cavity through the outer surface.

Example 13

The downhole tool of example 11, wherein the rotating mandrel further comprises a fourth conduit extending from the cavity to the upper surface.

Example 14

The downhole tool of example 11, further comprising a mandrel cover having one or more return ports, and wherein the mandrel comprises one or more first conduits that align with the one or more return ports when the mandrel is rotated to a first position.

Example 15

The downhole tool of example 14, wherein the first conduit comprises a valve that restricts flow from the upper surface to the lower surface while enabling flow from the lower surface to the upper surface.

Example 16

A method of completing a wellbore including deploying a service tool within a portion of a workstring that extends into the wellbore such that a first annulus is created between the workstring and a portion of the wellbore, wherein a packer is positioned on the workstring and adapted to seal across the first annulus, and wherein a screen is positioned downhole from the packer, and wherein the service tool comprises a rotating mandrel, wherein deploying the service tool comprises forming a seal within the workstring downhole from the packer. The method also includes rotating the rotating mandrel to a first position in which the mandrel restricts fluid flow from a tool bore of the service tool, and pressurizing fluid within the workstring to set the packer.

Example 17

The method of example 16, wherein the service tool comprising an inner sleeve having an inner port and an outer sleeve having an outer port, and wherein the rotating mandrel is positioned between the inner sleeve and outer sleeve, the inner sleeve forming an upper tool annulus between the inner sleeve and outer sleeve uphole from the rotating mandrel and a lower tool annulus between the inner sleeve and outer sleeve downhole from the rotating mandrel, and wherein the outer sleeve forms a second annulus between the service tool and the workstring, wherein rotating the mandrel to the first position comprises rotating the rotating mandrel into a position in which the rotating mandrel restricts fluid flow across the inner port.

Example 18

The method of example 17, wherein the rotating mandrel comprises an upper surface, a lower surface, an outer surface, and a cavity that is fluidly coupled to the tool bore of the service tool.

Example 19

The method of example 18, further comprising rotating the rotating mandrel to a second position to permit fluid flow across a washdown conduit of the mandrel, the washdown conduit extending from the cavity to the lower surface, and wherein the washdown conduit forms a fluid flow path from the tool bore to the lower tool annulus.

Example 20

The method of example 18, further comprising rotating the rotating mandrel to a third position in which fluid is permitted to flow across a circulation conduit extending from the cavity through the outer surface, wherein the circulation conduit fluidly couples the inner port to the outer port.

Example 21

The method of example 20, wherein fluid is permitted to flow flowing across a return conduit extending from the lower surface to the upper surface when the rotating mandrel is rotated into the third position.

Example 22

The method of example 18, further comprising rotating the rotating mandrel to a fourth position in which fluid is permitted to flow across a reverse flow conduit extending from the cavity to the upper surface, and wherein the reverse flow conduit is fluidly coupled to the inner port to provide a fluid flow path from the tool bore to the upper tool annulus.

Example 23

The method of example 18, further comprising rotating the rotating mandrel to a fifth position in which fluid is permitted to flow across a circulation conduit extending from the cavity through the outer surface, wherein the circulation conduit fluidly couples the inner port to the outer port, and wherein fluid is restricted from flowing across a return conduit extending from the lower surface to the upper surface.

We claim:

1. A system for use in a wellbore comprising:

a portion of a workstring extending into the wellbore;

a packer adapted to seal across a first annulus between the workstring and a portion of the wellbore; a screen downhole from the packer; and a service tool comprising a rotating mandrel positionable within the workstring, wherein the rotating mandrel is operable to control fluid flow from a tool bore of the service tool;

wherein the rotating mandrel is operable to provide a fluid flow path between a lower tool annulus and an upper tool annulus when the rotating mandrel is rotated into a first position.

2. The system of claim 1, wherein the service tool further comprises an inner sleeve having an inner port, and an outer sleeve having an outer port, and wherein the rotating mandrel is positioned between the inner sleeve and outer sleeve, the inner sleeve defining:

the upper tool annulus between the inner sleeve and the outer sleeve uphole from the rotating mandrel; and the lower tool annulus between the inner sleeve and the outer sleeve downhole from the rotating mandrel.

3. The system of claim 2, wherein: the service tool further comprises a mandrel cover having one or more return ports; the rotating mandrel further comprises one or more return conduits; and wherein the rotating mandrel is operable to control fluid flow across the return ports.

4. The system of claim 3, wherein the one or more return conduits align with the one or more return ports to provide the fluid flow path between the lower tool annulus and the upper tool annulus when the rotating mandrel is rotated into the first position.

5. The system of claim 4, wherein the rotating mandrel is operable to rotate about a central axis, and wherein the rotating mandrel comprises an upper surface, a lower surface, an outer surface, and a cavity that is fluidly coupled to the tool bore of the service tool.

6. The system of claim 5, wherein the rotating mandrel comprises a washdown conduit extending from the cavity to the lower surface, and wherein the washdown conduit aligns with the inner port to provide a fluid flow path between the inner port to the lower tool annulus when the rotating mandrel is rotated into a second position.

7. The system of claim 5, wherein the rotating mandrel comprises a circulation conduit extending from the cavity through the outer surface, and wherein the circulation conduit aligns with the inner port and outer port to provide a fluid flow path therebetween when the rotating mandrel is rotated into a third position.

8. The system of claim 7, wherein: the one or more return conduits align with the one or more return ports to provide a fluid flow path between the lower tool annulus and the upper tool annulus when the rotating mandrel is rotated into the third position.

9. The system of claim 5, wherein the rotating mandrel comprises a reverse flow conduit extending from the cavity to the upper surface, and wherein the reverse flow conduit is fluidly coupled to the inner port to provide a fluid flow path between the tool bore and the upper tool annulus when the rotating mandrel is rotated into a fourth position.

10. The system of claim 9, wherein: the one or more return conduits align with the one or more return ports to provide the fluid flow path between the lower tool annulus and the upper tool annulus when the rotating mandrel is rotated into the fourth position.

11. A downhole tool comprising:

a rotating mandrel having an upper surface, a lower surface, and an outer surface, and a cavity, the rotating mandrel comprising a first conduit extending from the upper surface to the lower surface and a second conduit extending from the cavity to the lower surface;

wherein the rotating mandrel is operable to provide a fluid flow path between a lower tool annulus and an upper tool annulus when the rotating mandrel is rotated into a first position.

12. The downhole tool of claim 11, wherein the rotating mandrel further comprises a third conduit extending from the cavity through the outer surface.

13. The downhole tool of claim 11, wherein the rotating mandrel further comprises a fourth conduit extending from the cavity to the upper surface.

14. The downhole tool of claim 11, further comprising a mandrel cover having one or more return ports, and wherein the mandrel comprises one or more of the first conduits that align with the one or more return ports when the mandrel is rotated to the first position.

15. The downhole tool of claim 14, wherein the first conduit comprises a valve that restricts flow from the upper surface to the lower surface while enabling flow from the lower surface to the upper surface.

16. A method of completing a wellbore comprising:

deploying a service tool within a portion of a workstring that extends into the wellbore such that a first annulus is created between the workstring and a portion of the wellbore, wherein a packer is positioned on the workstring and adapted to seal across the first annulus, and wherein a screen is positioned downhole from the packer, and wherein the service tool comprises a rotating mandrel, wherein deploying the service tool comprises forming a seal within the workstring downhole from the packer;

rotating the rotating mandrel to a first position in which the mandrel restricts fluid flow from a tool bore of the service tool and provides a fluid flow path between a lower tool annulus and an upper tool annulus; and pressurizing fluid within the workstring to set the packer.

17. The method of claim 16, wherein the service tool comprising an inner sleeve having an inner port and an outer sleeve having an outer port, and wherein the rotating mandrel is positioned between the inner sleeve and outer sleeve, the inner sleeve forming the upper tool annulus between the inner sleeve and outer sleeve uphole from the rotating mandrel and the lower tool annulus between the inner sleeve and outer sleeve downhole from the rotating mandrel, and wherein the outer sleeve forms a second annulus between the service tool and the workstring, wherein rotating the mandrel to the first position comprises rotating the rotating mandrel into a position in which the rotating mandrel restricts fluid flow across the inner port.

18. The method of claim 17, wherein the rotating mandrel comprises an upper surface, a lower surface, an outer surface, and a cavity that is fluidly coupled to the tool bore of the service tool.

19. The method of claim 18, further comprising rotating the rotating mandrel to a second position to permit fluid flow across a washdown conduit of the mandrel, the washdown conduit extending from the cavity to the lower surface, and wherein the washdown conduit forms a fluid flow path from the tool bore to the lower tool annulus.

20. The method of claim 18, further comprising rotating the rotating mandrel to a third position in which fluid is permitted to flow across a circulation conduit extending from the cavity through the outer surface, wherein the circulation conduit fluidly couples the inner port to the outer port.

* * * * *